US012281865B2

(12) United States Patent
Brooks

(10) Patent No.: US 12,281,865 B2
(45) Date of Patent: Apr. 22, 2025

(54) MECHANICAL VELOCITY ENHANCEMENT ASSEMBLY

(71) Applicant: Eddie L Brooks, Tylertown, MS (US)

(72) Inventor: Eddie L Brooks, Tylertown, MS (US)

( * ) Notice: Subject to any disclaimer, the term of this patent is extended or adjusted under 35 U.S.C. 154(b) by 103 days.

(21) Appl. No.: 18/180,748

(22) Filed: Mar. 8, 2023

(65) Prior Publication Data

US 2024/0035761 A1 Feb. 1, 2024

Related U.S. Application Data

(60) Provisional application No. 63/317,836, filed on Mar. 8, 2022.

(51) Int. Cl.
*F41A 1/06* (2006.01)

(52) U.S. Cl.
CPC ..... *F41A 1/06* (2013.01)

(58) Field of Classification Search
CPC ..... F41A 1/06
USPC ..... 89/8
See application file for complete search history.

(56) References Cited

U.S. PATENT DOCUMENTS

| | | | | |
|---|---|---|---|---|
| 1,458,686 A * | 6/1923 | Dawson | F41A 25/02 89/43.01 |
| 4,753,154 A * | 6/1988 | Higashi | F41A 13/12 165/104.26 |
| 8,826,792 B1 * | 9/2014 | Granger | F41A 1/04 89/7 |
| 11,920,888 B2 * | 3/2024 | Warren | F41B 11/723 |

* cited by examiner

*Primary Examiner* — Samir Abdosh
(74) *Attorney, Agent, or Firm* — Law Office of Jeff Williams PLLC; J. Oliver Williams

(57) ABSTRACT

A supplemental propulsion system for a weapon used to fire a projectile includes a barrel and chamber to hold a projectile round. A translating pressure tank surrounds a portion of the barrel, and the pressure tank is configured to translate along the barrel. A recoil spring assembly includes a spring and a pressure plate downstream of the chamber for holding the projectile round. The pressure tank is coupled to the pressure plate such that the spring is configured to stretch upon firing of the projectile and translate the pressure tank along a length of the barrel. The barrel includes a first port configured to selectively align with a first tank port during translation, for the discharge of pressurized gas from the pressure tank. The discharge of pressurized gas occurs rearward of the projectile as it passes through the barrel after firing.

8 Claims, 2 Drawing Sheets

Manual Repressurization, Big Bore Shoulder Guns etc., (top view)

Figure 2 is an extension of Figure 1 (for complete Element Identification
Manual Repressurization, Big Bore Shoulder Guns etc., {top view}
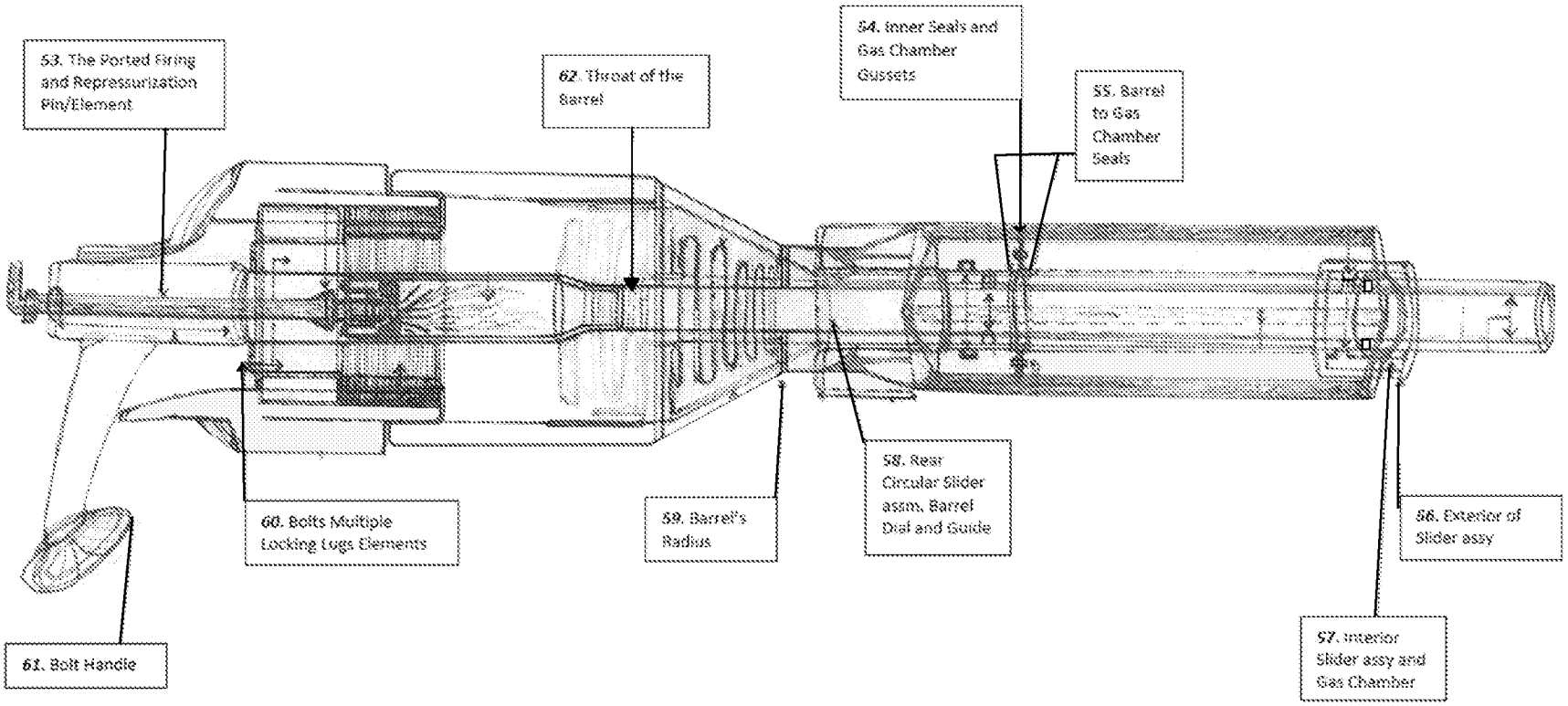

MECHANICAL VELOCITY ENHANCEMENT ASSEMBLY

CROSS REFERENCE TO RELATED APPLICATIONS

This application claims the benefit of an earlier filing date and right of priority to U.S. Provisional Application No. 63317836, filed 8 Mar. 2022, the contents of which is incorporated by reference herein in its entirety.

BACKGROUND OF THE INVENTION

1. Field of the Invention

The present application relates to guns and ammunition, and more particularly to a method of increasing velocity of a projectile fired from a weapon.

2. Description of Related Art

Every projectile for artillery shell that is fired using a firing pin to contact a primer to explosive powder which rapidly increases the pressure within the chamber and propels the projectile forward down the barrel's length to the crown. Multiple choices within various designs, barrel length, types of powder, types of lands, barrel diameter, projectile diameter, and projectile profiles may affect the velocity of a projectile and the distance to which it can accurately travel. A single discharge of the powder only produces one propulsion force which quickly diminishes as the projectile travels through the barrel, to the point of impact. Although strides have been made, shortcomings remain. It is desired that a system be set up to increase the speed of the projectile through the introduction of a longer repressurization force or by/from supplemental repressurization force applied after firing but prior to the exiting of the projectile from the chamber.

BRIEF SUMMARY OF THE INVENTION

It is an object of the present application is to provide a mechanical supplemental charge system for a firearm or any projectile firing device. The system is designed to provide additional propulsion via a release of pressure stored within a translating pressure tank adjacent the barrel.

It is a further object to incorporate pressure discharge ports along the length of the barrel to coincide with the translating tank such that translation of the pressure tank selectively and temporarily aligns the ports to discharge a force of pressure from the tank. Ports may be located along the length of the barrel to induce multiple releases of pressure to assist in the propulsion of the bullet or projectile.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

FIG. 2 is a second side section view of the enhancement of FIG. 1.

Figure 1:
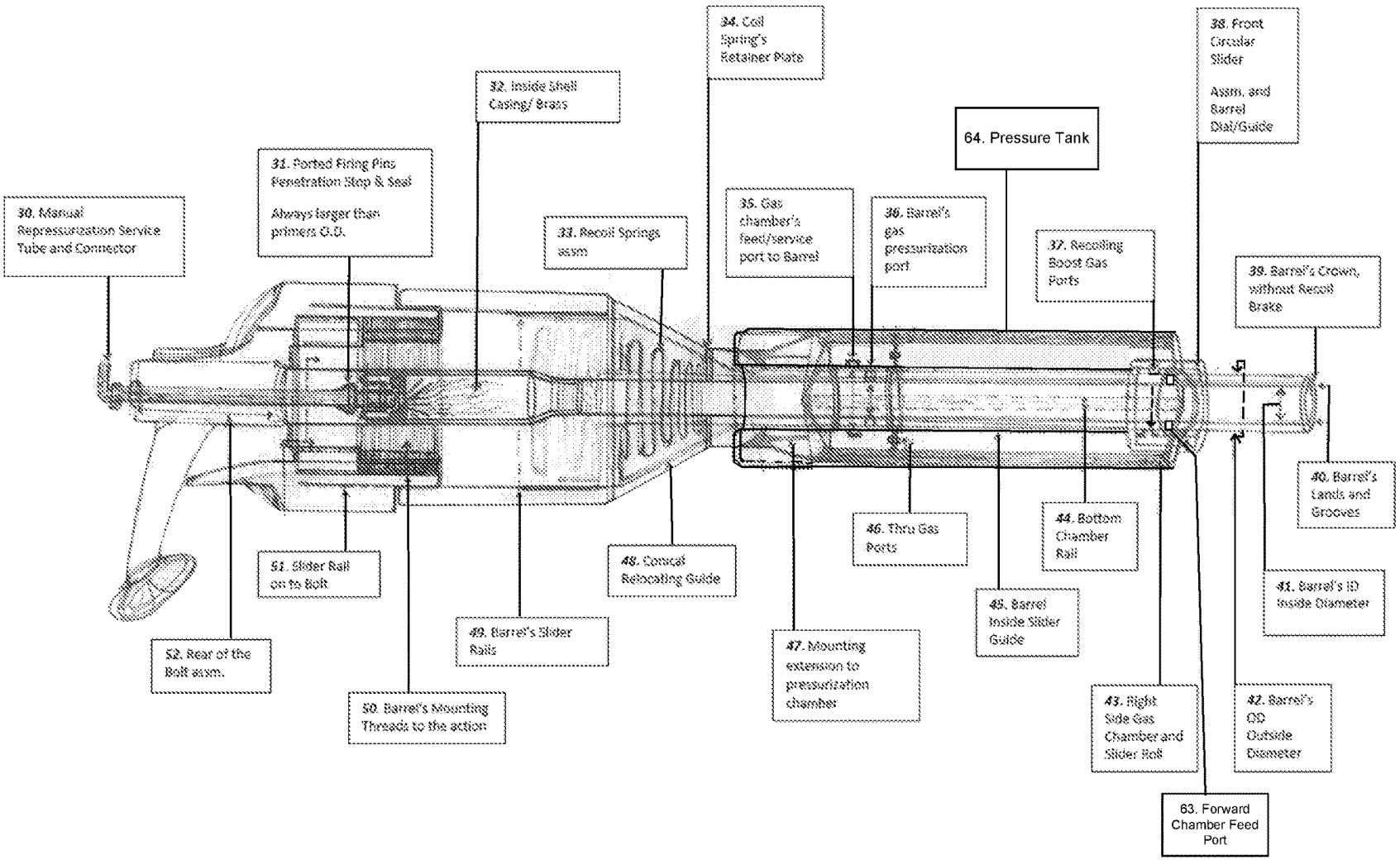
FIG. 1 is a top view of a firearm with mechanical artillery enhancement according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE INVENTION

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

The mechanical artillery enhancement of the present application is configured to induce a repressurization within the firearm chamber following the firing of ammunition. The secondary propulsive pressure repressurizes the chamber behind the movement of the projectile after the projectile leaves the throat, entering the barrel. This acts to increase the propulsive forces applied to the projectile which induces greater velocity to the projectile and helps to flatten the path of travel so as to increase the accuracy of the projectile.

This concept is best described as the technological and methodical controls of gas pressurizations, burn rate, heat produced, and ambient conditions to create maximum versatility. In part this methodology includes at least a Trio of calculations including a constant presence, producing/manufacturing of firearms, and such like products this concept might be quickly comprehended and applied; for usage within small to large calibers conventional, and highly technical firearms, and similar devices more importantly the primary focus for this concept was and is to even better equip the United States of America or the American Department of Defense with these added values.

Species disclosed in the Figures act as a manual repressurization of big-bore shoulder guns, etc. This species depicts numeric and verbal call-outs of virtually all elements and/or components needed to manufacture this product. The above-described draft is a modified manual repressurization function within motions of manual conventional big-bore shoulder guns without an electrical assist in calibers from 7 mm caliber up to 8" artillery weapons.

Referring now to FIGS. 1 and 2 in the drawings, a set of top views are illustrated of the invention. The Figures are focused on the firing mechanism and chamber of the firearm. Although shown with respect to a firearm it is understood to equally apply in principle of operation to larger projectiles that extend beyond hand held firearms. In operation the chamber/barrel is ported downstream to the projectile prior to firing. The ports are pressurized and are prevented from expelling the pressure as the slide is sealing it in its pre-fire condition. Upon firing of the projectile, the slide recoils back and the pressure tank 64 translates forward from the explosive forces of firing the projectile. The translation of the tank 64 sequentially aligns the ports 35, 37 in the tank 64 with those of the chamber ports 36, 63 and temporarily allow for the expelling of additional pressurized gas through the chamber. This gas induces an additional pressure force onto the rear of the projectile as it travels down the barrel. This helps to increase the velocity of the projectile/bullet which increases accuracy and flattens the path of travel. The release of pressure through the ports are automatic and mechanically controlled through recoil action of the slide upon firing.

Users can achieve at least a trio of benefits from this concept when applying progressive modifications such as a reengineered ported firing pin/primer pin, with a fitted gas recharging/reenergizing supply, having specifications engineered to provide correct reenergizing pressurization, types of gases, volume of gases and, the correct accompanying connecting materials attached to the injecting firing pin/ported firing pin and/or both functioning simultaneously to/for increasing bore and or barrel pressures on command when needed or when wanted. (The advantages of these functions named/described above) are: (A) Achieving the ambition to shoot special need firearms of any caliber extremely long distances when needed or desired; (B) being accomplished in/within shooting large caliber firearms with extreme velocity without destroying the shell casing/brass, the weapon and certain bullets; and (C) to maintain outstanding exceptional accuracy while accomplishing A&B.

As seen in the figures, the bullet casing 32 is shown in the chamber. Spring assembly 33 is located forward of the casing 32. The spring assembly 33 is in a compressed state prior to filing. It is bound between retainer plate 34 and the bullet chamber. When firing, the explosive pressures push against the retainer plate 34 and elongate the spring. Pressure tank 64 is configured to translate along the chamber/barrel and is moved by action of the spring assembly 33.

Pressure tank 64 holds an amount of pressurized gas. The gas is held within the tank at a selected volume. A check valve or seal is located in communication with the tank 64 to prevent over pressurization. Through port 46 is used as a manner to charge tank 64. As seen in the Figures, the chamber/barrel has ports 36 and 63. Prior to translation of tank 64, the ports are closed by the tank as they are misaligned with corresponding ports 35 and 37 in the tank. A goal of the invention is to provide a mechanically timed discharge of supplemental propulsive gases behind the projectile as it translates through the barrel upon firing. Therefore, it is ideal that ports 35 and 36 align ever so sooner than ports 37 and 63. Once fully translated, tank 64 recoils backward from the tension in the extended spring assembly 33.

It is understood that the tank 64 includes enough pressure to last more than one shot. The discharge through the ports is very quick. A secondary source of pressure is provided through tube 30. Tube 30 is connected to the weapon adjacent the firing pin. Once the firing pin ignites the primer of the projectile round, a gap or fluid passage forms in the casing. Pressurized air/gas is passed through tube 30 behind the projectile continuously as it passes through the entire chamber. This secondary propulsion method may be used in conjunction with or independent from the ported chambers with tank 64.

The current application has many advantages over the prior art as mentioned herein, such as (1) Deploying artillery fire power from 30-35% further distance of areas/radius; (2) Firing with greater accuracy; and (3) A broader scope of versatility within one firearm/weapon safety and less risk for the boots on the ground.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A supplemental propulsion system for a weapon used to fire a projectile comprising:

a barrel aligned with a chamber in the weapon, the chamber used to hold a projectile round;

a pressure tank surrounding a portion of the barrel, the pressure tank configured to translate along the barrel;

a recoil spring assembly including a spring and a pressure plate downstream of the chamber holding the projectile round, the pressure tank coupled to the pressure plate, the spring configured to stretch upon firing of the projectile and translate the pressure tank along a length of the barrel;

wherein the barrel includes a first port, the first port selectively aligning with a first tank port during translation for the discharge of pressurized gas from the pressure tank; and wherein the discharge of pressurized gas occurs rearward of the projectile as it passes through the barrel after firing.

2. The system of claim 1, further comprising:

a second port in the barrel, the second port being forward of the first port, the second port selectively aligning with a second tank port during translation for the selective discharge of the pressurized gas from the pressure tank.

3. The system of claim 2, wherein the second port aligns with the second tank port after the first port aligns with the first tank port.

4. The system of claim 2, further comprising:

a tube coupled to the firing pin, the tube containing pressurized gas to push the projectile through the entire length of the barrel after firing of the projectile.

5. The system of claim 1, wherein the pressure tank translates forward away from the chamber.

6. The system of claim 1, wherein the pressure tank includes a through port to charge the tank with pressurized gas.

7. The system of claim 1, wherein the pressure tank includes a check valve to regulate pressure in the pressure tank.

8. The system of claim 1, further comprising:

a tube coupled to the firing pin, the tube containing pressurized gas to push the projectile through the entire length of the barrel after firing of the projectile.

* * * * *